US008107646B2

(12) United States Patent
Tamura

(10) Patent No.: US 8,107,646 B2
(45) Date of Patent: Jan. 31, 2012

(54) ACOUSTIC VIBRATION GENERATING ELEMENT

(75) Inventor: Mitsuo Tamura, Sendai (JP)

(73) Assignee: NEC TOKIN Corporation, Sendai-shi (JP)

( * ) Notice: Subject to any disclaimer, the term of this patent is extended or adjusted under 35 U.S.C. 154(b) by 1073 days.

(21) Appl. No.: 11/961,799

(22) Filed: Dec. 20, 2007

(65) Prior Publication Data

US 2008/0107290 A1 May 8, 2008

Related U.S. Application Data

(62) Division of application No. 10/990,117, filed on Nov. 15, 2004, now abandoned.

(30) Foreign Application Priority Data

Dec. 12, 2003 (JP) ..... 2003-414064

(51) Int. Cl.
*H04R 25/00* (2006.01)

(52) U.S. Cl. ..... 381/151; 381/173; 381/190

(58) Field of Classification Search ..... 381/322, 381/324, 326, 151, 173, 190, 191, 330; 310/324, 310/328, 800; 29/25.35
See application file for complete search history.

(56) References Cited

U.S. PATENT DOCUMENTS

| | | | | |
|---|---|---|---|---|
| 3,030,456 | A | 4/1962 | Knauert | |
| 4,596,903 | A | 6/1986 | Yoshizawa | |
| 4,654,554 | A | 3/1987 | Kishi | |
| 5,277,694 | A * | 1/1994 | Leysieffer et al. | 600/25 |
| 5,367,500 | A * | 11/1994 | Ng | 367/157 |
| 5,411,467 | A | 5/1995 | Hortmann et al. | |
| 6,141,427 | A | 10/2000 | Fukuda | |
| 6,411,012 | B2 * | 6/2002 | Furukawa et al. | 310/328 |
| 6,570,299 | B2 | 5/2003 | Takeshima et al. | |
| 6,668,065 | B2 | 12/2003 | Lee et al. | |
| 6,735,319 | B1 | 5/2004 | Vonlanthen | |
| 7,180,225 | B2 | 2/2007 | Sashida et al. | |
| 2003/0048913 | A1 | 3/2003 | Lee et al. | |

FOREIGN PATENT DOCUMENTS

| | | | |
|---|---|---|---|
| CN | 1354966 | A | 6/2002 |
| GB | 1 277 912 | A | 6/1972 |
| JP | 59-140796 | A | 8/1984 |
| JP | 59-178895 | A | 10/1984 |

(Continued)

OTHER PUBLICATIONS

Chinese Office Action dated Jan. 23, 2009 and English translation thereof issued in a counterpart Chinese Application No. 200410098275X.

*Primary Examiner* — Huyen D Le
(74) *Attorney, Agent, or Firm* — Holtz, Holtz, Goodman & Chick, PC

(57) ABSTRACT

In an acoustic vibration generating element, a piezoelectric bimorph element or unimorph element is covered with a covering member of a flexible material at least on two surfaces perpendicular to a thickness direction. The covering member may be provided with a plurality of V-shaped grooves so as to improve a generated vibrating force. Alternatively, the covering member may be provided with an air chamber in the vicinity of a surface of one side so as to prevent sound leakage. Further, the covering member and an earhook may be integrally formed by the flexible material so as to achieve a light-weight acoustic vibration generating element suitable for a bone conduction speaker.

21 Claims, 6 Drawing Sheets

FOREIGN PATENT DOCUMENTS

| | | | |
|---|---|---|---|
| JP | 59-204399 | A | 11/1984 |
| JP | 59-209000 | A | 11/1984 |
| JP | 3-237900 | A | 10/1991 |
| JP | 4-077095 | A | 3/1992 |
| JP | 2967777 | B1 | 8/1999 |
| JP | 2002-10393 | A | 1/2002 |
| JP | 3358086 | A | 10/2002 |
| JP | 2003-032768 | A | 1/2003 |
| JP | 2003-219499 | A | 7/2003 |

* cited by examiner

ACOUSTIC VIBRATION GENERATING ELEMENT

The present application is a Divisional Application of U.S. application Ser. No. 10/990,117 filed Nov. 15, 2004, now abandoned, which claims priority to prior Japanese patent application JP 2003-414064, the disclosures of which are incorporated herein by reference.

BACKGROUND OF THE INVENTION

This invention relates to an acoustic vibration generating element. In particular, this invention is suitable for a bone conduction device, such as a bone conduction speaker, for converting an acoustic electric signal into acoustic vibration to be transmitted to a part of a human body, such as a cranial bone or an arm, so that an acoustic sound is sensed by an auditory nerve.

Heretofore, as an electromechanical transducer for a bone conduction device, use is predominantly made of an electromagnetic type. The electromechanical transducer of the electromagnetic type utilizes a principle same as that of a dynamic speaker and converts a driving force generated by interaction between an electric current flowing through a coil and a magnet into mechanical vibration. The electromechanical transducer of the type is disclosed, for example, in Japanese Patents (JP-B) Nos. 2967777 (corresp. to U.S. Pat. No. 6,141,427) and 3358086 (corresp. to U.S. Pat. No. 6,668,065).

However, the electromechanical transducer of the electromagnetic type is disadvantageous in the following respects. The electromechanical transducer of the electromagnetic type generates an electromagnetic force and therefore requires the electric current. When the electric current flows through the coil, an energy loss inevitably occurs by a resistance of the coil. Thus, most of energy supplied from a power source is dissipated at the coil as Joule heat and only about 1% of the energy is used as acoustic energy. Further, in a low-frequency region, the electric current tends to be excessive because of low impedance so that a load upon the power source is increased. As a result, a sound output level is inevitably limited in the low-frequency region. Thus, in the low-frequency region, the sound output level tends to be insufficient.

On the other hand, proposal is made of a transducer for a bone conduction device, i.e., a bone conduction transducer which uses a piezoelectric element, although in a minority. The bone conduction transducer using the piezoelectric element comprises, as an acoustic vibration generating element, a piezoelectric unimorph element which is often used as a piezoelectric sound generator. The piezoelectric unimorph element comprises a metal plate and a piezoelectric plate adhered thereto. The bone conduction transducer of the type is disclosed, for example, in Japanese Patent Application Publications (JP-A) Nos. S59-140796 and S59-178895.

However, the bone conduction transducer using the piezoelectric element is disadvantageous in the following respects. Specifically, the bone conduction transducer using the piezoelectric element has a resonance frequency of 1 kHz or more if the bone conduction transducer has a practical size. Therefore, reproduction in the low-frequency region lower than the resonance frequency is insufficient. Further, since a mechanical quality factor Q of a vibrating system is high, generation of vibration is emphasized or attenuated at a specific frequency. In this event, sound reproduction can not naturally and normally be carried out.

As an example of the bone conduction device, there is also provided a bone conduction speaker not for a hearing-impaired person but for an unimpaired person. The bone conduction speaker of the type is required to prevent a reproduced sound from leaking to others except a user. However, with a known structure of the bone conduction speaker, vibration of a vibration source propagates to a structural member. As a result, the vibration of the structural member is propagated to the surroundings as the reproduced sound.

In bone conduction applications of the piezoelectric element, a resonance frequency of the piezoelectric element must be as low as possible if the low-frequency region is regarded as important. In order to lower the resonance frequency of the piezoelectric element, the following techniques A to C are proposed.

A. To increase a diameter or a length of the piezoelectric element, which determines a vibration mode.

B. To lower a flexural modulus K of the piezoelectric element.

C. To add a mass to an antinode of vibration.

However, if an object equipped with the piezoelectric element is a portable apparatus such as a mobile phone and, therefore, the size of the piezoelectric element is restricted, the technique A has limitations.

The technique B is achieved by reducing the thickness of a piezoelectric ceramics sheet in case of a piezoelectric unimorph element and by reducing the thickness of a metal plate (shim plate) interposed between two piezoelectric ceramics sheets in case of a piezoelectric bimorph element. However, in this technique, the mechanical strength of the piezoelectric element is lowered. In addition, the weight of the piezoelectric element itself is decreased so that the resonance frequency is increased. Therefore, no substantive effect is obtained. Alternatively, by selecting an organic material having a small elastic modulus as the shim plate, the flexural modulus K can be lowered to some extent. However, the organic material generally has a small specific gravity so that the weight of a whole of the piezoelectric element is decreased. Therefore, the resonance frequency tends to be increased.

The technique C of adding the mass is disadvantageous in that the mechanical strength tends to be weakened against shocking vibration.

In a piezoelectric transducer such as the above-mentioned bone conduction transducer using the piezoelectric element, mechanical vibration is driven by piezoelectric distortion which is caused by an electric voltage. Therefore, the piezoelectric transducer is not accompanied with dissipation of Joule heat by the coil in the above-mentioned electromechanical transducer of the electromagnetic type. Therefore, it is possible to achieve energy saving. In addition, since metal components such as a magnet and a yoke are not required, a light weight and a thin profile can be achieved. Thus, the piezoelectric transducer has many advantages. In order to fully enjoy those advantages, the piezoelectric transducer is required to overcome the disadvantages such as a high resonance frequency and a high mechanical quality factor Q.

On the other hand, prevention of sound leakage to the surroundings is an unavoidable issue in order to bring the bone conduction speaker into practical use, whether electromagnetic or piezoelectric. In order to further exhibit the characteristics of the piezoelectric transducer, an input driving voltage is preferably suppressed as low as possible. In this event, energy loss of a driving circuit combined with the piezoelectric transducer is advantageously suppressed.

Further, the bone conduction speaker is generally attached to a human head when it is used. Therefore, it is desired for a user that the bone conduction speaker is light in weight and is easily wearable.

SUMMARY OF THE INVENTION

It is therefore an object of this invention to achieve a lower resonance frequency, a lower mechanical quality factor Q, and suppression of sound leakage in a bone conduction device, in particular, a bone conduction speaker.

A bone conduction acoustic vibration generating element according to this invention comprises a piezoelectric bimorph or unimorph element and a covering or coating member made of a flexible material and covering at least two surfaces perpendicular to a thickness direction of the piezoelectric bimorph or unimorph element.

In the bone conduction acoustic vibration generating element according to this invention, a whole of the piezoelectric bimorph element or the piezoelectric unimorph element may be covered with the covering member.

In the bone conduction acoustic vibration generating element according to this invention, the piezoelectric bimorph element may have a laminated structure comprising piezoelectric ceramics sheets and internal electrodes.

In the bone conduction acoustic vibration generating element according to this invention, the covering member may be provided with a plurality of grooves formed on its surface.

In the bone conduction acoustic vibration generating element according to this invention, the covering member may be provided with an air chamber formed on one side thereof.

The bone conduction acoustic vibration generating element according to this invention may have an earhook portion made of the flexible material and integrally formed with the covering member.

DESCRIPTION OF THE PREFERRED EMBODIMENTS

Figure 1A:
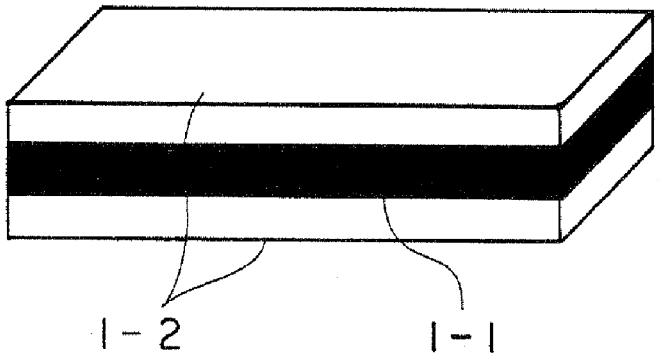
FIG. 1A is a perspective view of an acoustic vibration generating element according to this invention in case where a piezoelectric element has opposite surfaces covered with a flexible material.

Now, description will be made of this invention with reference to the drawing.

At first referring to FIGS. 1A, 1B, 2, and 3, a basic structure and a principle of this invention will be described in detail.

Referring to FIG. 1A, an acoustic vibration generating element according to this invention comprises a piezoelectric bimorph element (or piezoelectric unimorph element) 1-1 and a pair of covering members 1-2 attached to two surfaces perpendicular to a thickness direction of the piezoelectric bimorph element 1-1.

Figure 1B:
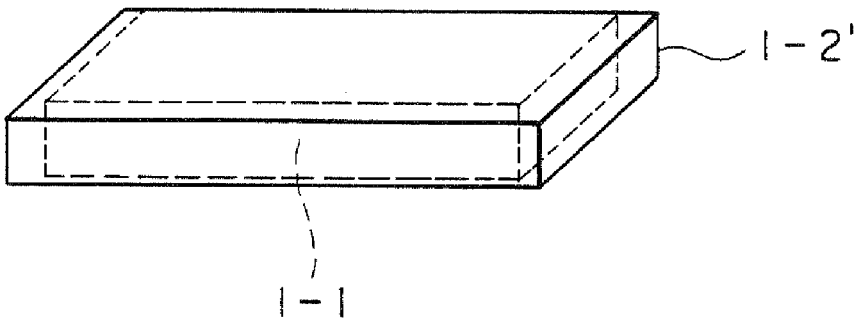
FIG. 1B is a perspective view of another acoustic vibration generating element according to this invention in case where a piezoelectric element is entirely covered with a flexible material.

Referring to FIG. 1B, another acoustic vibration generating element according to this invention comprises the piezoelectric bimorph element (or piezoelectric unimorph element) 1-1 entirely covered with a covering member 1-2'. The covering members 1-2 and 1-2' are made of a flexible material.

Figure 2:
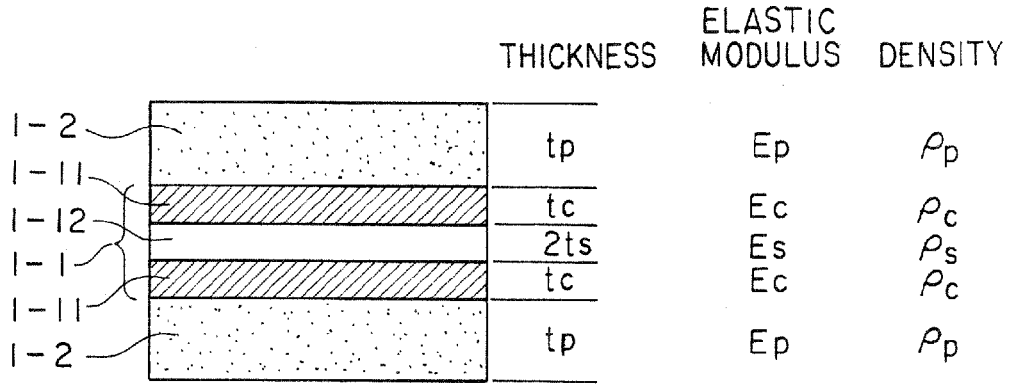
FIG. 2 is a sectional view of the acoustic vibration generating element in FIG. 1A in case where the piezoelectric element is a piezoelectric bimorph element.

Referring to FIG. 2, the acoustic vibration generating element in FIG. 1A comprises the piezoelectric bimorph element 1-1 and the covering members 1-2 attached to opposite surfaces thereof, i.e., two surfaces perpendicular to the thickness direction of the piezoelectric bimorph element 1-1. The piezoelectric bimorph element 1-1 comprises two piezoelectric ceramics sheets 1-11 and a shim plate 1-12 interposed therebetween.

Referring to FIG. 2, the principle of this invention will be described. For convenience of description, it is assumed that the piezoelectric bimorph element 1-1 has a rectangular shape. The piezoelectric bimorph element 1-1 has a resonance frequency $F_r$ which is different depending upon a supporting structure. If opposite ends of the piezoelectric bimorph element 1-1 are free ends, the resonance frequency $F_r$ is given by the following Equation (1). In Equation (1), $\alpha$ is a value determined by a vibration mode and is equal to 4.73 in primary resonance. L represents a length of the piezoelectric bimorph element 1-1, K, a flexural modulus, $\rho S$, a weight per unit length.

$$F_r = \frac{\alpha^2}{2\pi L^2}\sqrt{\frac{K}{\rho S}} \tag{1}$$

The flexural modulus K of the acoustic vibration generating element is determined by various factors such as the size and the material of each of the piezoelectric ceramics sheets 1-11 and the shim plate 1-12 forming the piezoelectric bimorph element 1-1, and the covering members 1-2. Specifically, the flexural modulus K is determined by the width w of each of the piezoelectric ceramics sheets 1-11 and the shim plate 1-12, the thickness $t_c$ and the elastic modulus $E_c$ of each of the piezoelectric ceramics sheets 1-11, the thickness $2t_s$ and the elastic modulus $E_s$ of the shim plate 1-12, and the thickness $t_p$ and the elastic modulus $E_p$ of each of the covering members 1-2 and is given by the following Equation (2).

$$K = \frac{2w}{3}\{E_s t_s^3 + E_c(3t_s^2 t_c + 3t_s t_c^2 + t_c^3) + E_p(3t_s^2 t_p + 6t_s t_c t_p + 3t_c^2 t_p + 3t_s t_p^2 + 3t_c t_p^2 + t_p^3\} \quad (2)$$

The weight ρS per unit length is determined by the thickness $t_c$, $2t_s$, and $t_p$ and the specific gravity $\rho_c$, $\rho_s$, and $\rho_p$ of each of the piezoelectric ceramics sheets 1-11, the shim plate 12, and the covering members 1-2 as well as the width w of the piezoelectric bimorph element 1-1 and is given by the following Equation (3).

$$\rho S = 2w(\rho_p t_p + \rho_c t_c + \rho_s t_s) \quad (3)$$

When the covering member 1-2 as a new layer is added to each of the opposite surfaces of the piezoelectric bimorph element 1-1, the flexural modulus K and the weight ρS per unit length are changed so that the resonance frequency is affected. Depending upon the material selected as the covering members 1-2, the resonance frequency of the acoustic vibration generating element may become high. In most cases, however, the resonance frequency is lowered. Specifically, if the covering members are formed by a flexible material having an elastic modulus not greater than a predetermined value, for example, a rubber having a small elastic modulus of $3\times10^6$ Pa to $8\times10^6$ Pa, the flexural modulus K of a whole of the acoustic vibration generating element is increased by addition of the new layer. However, an increasing rate of the flexural modulus K is small as compared with an increasing rate of the weight ρS per unit length. As a result, the resonance frequency of the acoustic vibration generating element is lowered.

Figure 3:
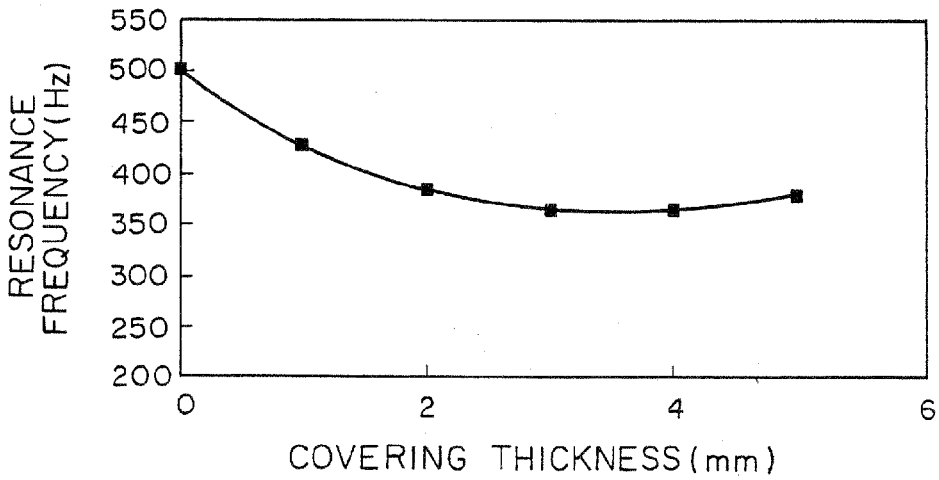
FIG. 3 is a characteristic chart showing the change in resonance frequency of the acoustic vibration generating element in FIG. 2 when a silicone rubber as a covering member is changed in thickness.

FIG. 3 shows the change in resonance frequency when a silicone rubber is used as the flexible material and a covering thickness of the flexible material is changed. From FIG. 3, it is understood that the flexible material has an effect of lowering the resonance frequency and simultaneously lowering the mechanical quality factor Q so that a frequency range is widened. Consideration will be made of an acoustic output of the acoustic vibration generating element as a bone conduction speaker. As the acoustic vibration generating element radiates acoustic energy in tight contact with a human skin, such a structure that the piezoelectric element is covered with the flexible material is suitable in view of acoustic impedance matching between the acoustic vibration generating element and the human skin. In particular, in case where the piezoelectric bimorph element is covered with the flexible material, an effect of suppressing sound leakage, i.e., radiation of unnecessary sound to the surroundings is achieved.

In the foregoing, description has been directed to the case where the acoustic vibration generating element has a rectangular shape. It is noted here that the similar effect is obtained in case where a piezoelectric bimorph or unimorph element of a circular shape is used.

Hereinafter, this invention will be described in conjunction with several preferred embodiments.

First Embodiment

Piezoelectric Bimorph Element of a Rectangular Shape

Preparation was made of a piezoelectric bimorph element having a rectangular shape and comprising two piezoelectric ceramics sheets (manufactured by NEC Tokin under the trade name of NEPEC10®) having the length of 32 mm, the width of 8 mm, and the thickness of 0.15 mm and a shim plate of brass having the length and the width equal to those of the piezoelectric ceramics sheets and the thickness of 50 μm. The piezoelectric bimorph element has a structure in which the shim plate is adhered between the two piezoelectric ceramics sheets by the use of an epoxy adhesive. Hereinafter, the above-mentioned structure will be called a single-plate structure.

Figure 4:
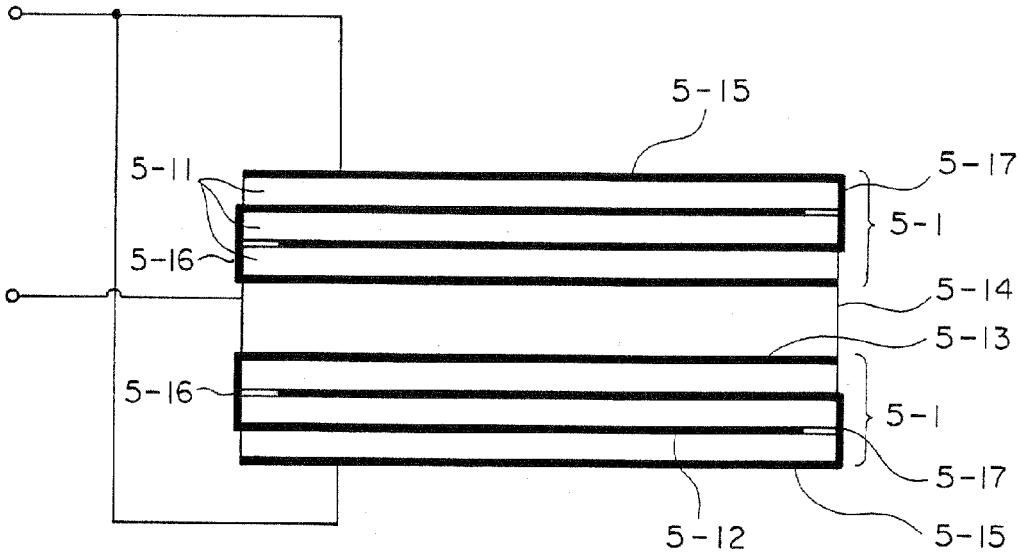
FIG. 4 is a perspective view of a piezoelectric bimorph element having a laminated structure which may be used in this invention.

On the other hand, as illustrated in FIG. 4, another piezoelectric bimorph element was produced in the following manner. Preparation was made of two sets of laminated piezoelectric ceramics members 5-1. Each of the laminated piezoelectric ceramics members 5-1 comprises three piezoelectric ceramics sheets 5-11 and two internal electrodes 5-12 interposed between adjacent ones of the piezoelectric ceramics sheets 5-11. Each of the piezoelectric ceramics sheets 5-11 is made of a material same as that of the above-mentioned piezoelectric ceramics sheet and having the length and the width equal to those of the above-mentioned piezoelectric ceramics sheet and a thickness of 50 μm. Between the two sets of the laminated piezoelectric ceramics members 5-1, a metal shim plate 5-14 is interposed through internal electrodes 5-13. Each of the laminated piezoelectric ceramics members 5-1 has an outer surface provided with an external electrode 5-15. A first one of the internal electrodes 5-12 is connected to the internal electrode 5-13 via a side surface electrode 5-16. A second one of the internal electrodes 5-12 is connected to the external electrode 5-15 via a side surface electrode 5-17. In the following, the above-mentioned structure will be called a laminated structure. The above-mentioned structure will hereinafter be called a laminated structure.

In case of the piezoelectric bimorph element of the single-plate structure, lead wires are connected to outer surfaces of the shim plate and the piezoelectric ceramics sheets on opposite outermost surfaces through the electrodes so that, when an electric field is applied to one of the piezoelectric ceramics sheets in a direction same as a polarization direction, a reverse electric field is applied to the other piezoelectric ceramics sheet. Similarly, in case of the piezoelectric bimorph element of the laminated structure, lead wires are connected so that, when an electric field is applied to one of the piezoelectric ceramics sheets in the direction same as the polarization direction, a reverse electric field is applied to another piezoelectric ceramics sheet adjacent thereto.

Next, by the use of a brass die, a solution of silicone rubber as the flexible material was poured over an entire surface of the piezoelectric bimorph element. By a setting or curing process, acoustic vibration generating elements of a single-plate structure and a laminated structure were produced. Each of the acoustic vibration generating elements was provided with rubber covering having the thickness of 2 mm on two surfaces perpendicular to the thickness direction and the thickness of 1 mm on remaining surfaces.

When the acoustic vibration generating element of the single-plate structure was supplied with an acoustic signal of about 18 Vrms and one surface of the acoustic vibration generating element was pressed against a user's head, a clear sound by bone conduction was confirmed. The acoustic vibration generating element of the laminated structure produced an output of the equivalent level in response to an input of about 6 Vrms corresponding to ⅓ as compared with the single-plate structure.

Further, in order to evaluate a leaking sound, a sound pressure of 100 Hz to 10 kHz was measured at a distance of 50 cm in an anechoic chamber. As a result, it has been confirmed that, in each of the single-plate structure and the laminated structure, a sound pressure level was not greater than 50 dB. Thus, sound leakage was very small.

Next, in order to quantitatively confirm acoustic effects of the flexible material, an artificial internal ear (Artificial Mastoid Type 4930 manufactured by B & K) was used to measure and compare accelerations at a position corresponding to an auditory nerve of a human body before and after covering with the flexible material. It is noted that the magnitude of acceleration in the internal ear is proportional to the strength of the acoustic signal received by the auditory nerve.

Figure 5:
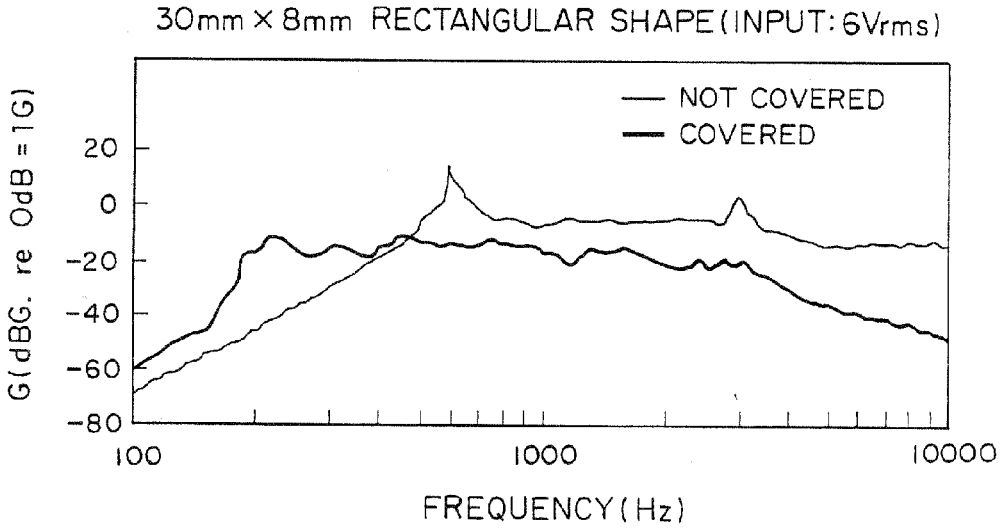
FIG. 5 is a characteristic chart showing a result of comparison of acceleration in an artificial internal ear between an acoustic vibration generating element covered with a flexible material according to a first embodiment of this invention and an acoustic vibration generating element without being covered with the flexible material.

FIG. 5 shows a result of comparison of acceleration (G) in the artificial internal ear. As is obvious from FIG. 5, it has been confirmed that, in case of the acoustic vibration generating element covered with the flexible material, the acceleration is improved in an output in a low-frequency region and the sharpness of a resonant portion is considerably alleviated.

Second Embodiment

Piezoelectric Bimorph Element of a Circular Shape

Preparation was made of a piezoelectric bimorph element having a circular shape and comprising two piezoelectric ceramics sheets (manufactured by NEC Tokin under the trade name of NEPEC10®) having the diameter of 30 mm and the thickness of 0.15 mm and a shim plate of brass having the diameter equal to that of the piezoelectric ceramics sheets and the thickness of 50 μm. The piezoelectric bimorph element has a structure in which the shim plate is adhered between the two piezoelectric ceramics sheets by the use of an epoxy adhesive. Hereinafter, the above-mentioned structure will be called a single-plate structure.

By the use of piezoelectric ceramics sheets made of a material same as the above-mentioned piezoelectric ceramics sheets and having the same diameter and the thickness of 50 μm, a circular piezoelectric bimorph element of a laminated structure was prepared in the manner similar to that described in conjunction with FIG. 4.

Wire connection was carried out in the manner similar to the first embodiment.

Next, by the use of a brass die, a solution of silicone rubber was poured over an entire surface of the piezoelectric bimorph element. By a setting or curing process, acoustic vibration generating elements of a single-plate structure and a laminated structure were produced. Each of the acoustic vibration generating elements was provided with rubber covering having the thickness of 2 mm on opposite surfaces perpendicular to the thickness direction and the thickness of 1 mm on remaining surfaces.

The acoustic vibration generating element of the single-plate structure and the acoustic vibration generating element of the laminated structure were supplied with acoustic signals of about 18 Vrms and about 6 Vrms, respectively. One surface of each of the acoustic vibration generating elements was pressed against a user's head. As a result, a clear sound by bone conduction was confirmed.

Further, in order to evaluate a leaking sound, a sound pressure of 100 Hz to 10 kHz was measured at a distance of 50 cm in an anechoic chamber. As a result, it has been confirmed that, in each of the single-plate structure and the laminated structure, a sound pressure level was not greater than 50 dB. Thus, sound leakage was very small.

Next, in order to quantitatively confirm acoustic effects of the flexible material, an artificial internal ear (Artificial Mastoid Type 4930 manufactured by B & K) was used to measure and compare accelerations at a position corresponding to an auditory nerve of a human body before and after covering with the flexible material. It is noted that the magnitude of acceleration in the internal ear is proportional to the strength of the acoustic signal received by the auditory nerve.

Figure 6:
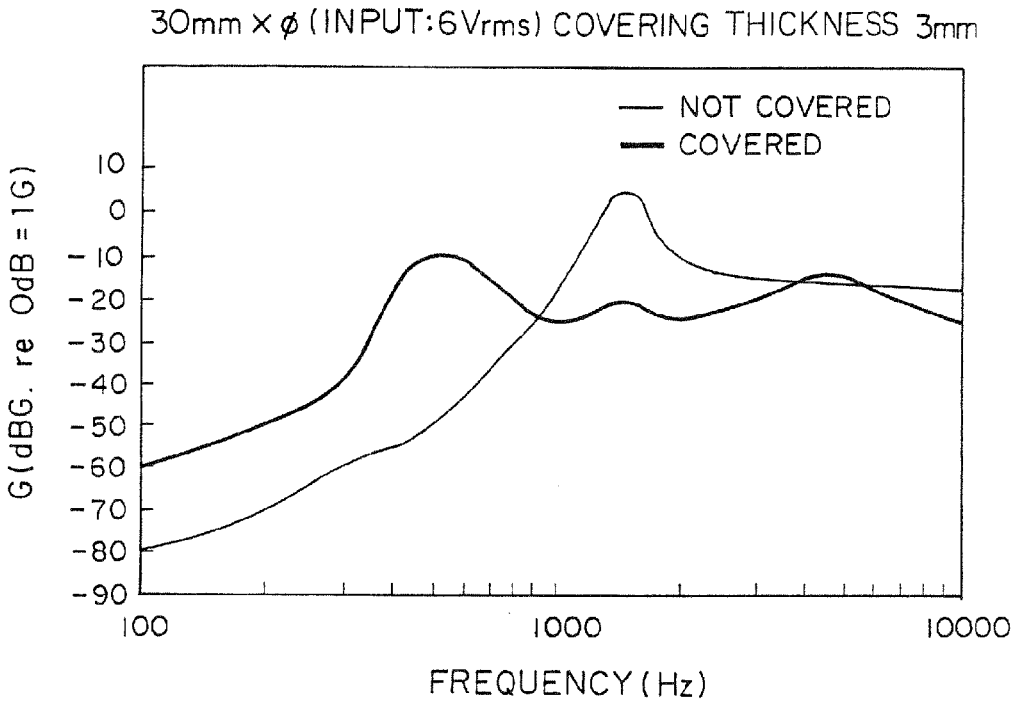
FIG. 6 is a characteristic chart showing a result of comparison of acceleration in an artificial internal ear between an acoustic vibration generating element covered with a flexible material according to a second embodiment of this invention and an acoustic vibration generating element without being covered with the flexible material.

FIG. 6 shows a result of comparison of acceleration (G) in the artificial internal ear. As is obvious from FIG. 6, it has been confirmed that, in case of the acoustic vibration generating element covered with the flexible material, the acceleration is improved also in a low-frequency region and the sharpness of a resonant portion is considerably alleviated. The effects of lowering the resonance frequency, decreasing the mechanical quality factor Q, and preventing sound leakage by the flexible material can be achieved not only by molding the silicone rubber as the flexible material but also by adhering the flexible material to a surface of the piezoelectric element.

Third Embodiment

Covering Member with V-Shaped Grooves on its Surface

The acoustic vibration generating element experimentally prepared in the first embodiment was subjected to mechanical machining to form a plurality of V-shaped grooves on two principal surfaces of the covering member of the flexible material (silicone rubber in the embodiment). Each of the V-shaped grooves has a depth of 0.6 mm and extends in a direction perpendicular to a lengthwise direction. Thus, an acoustic vibration generating element according to a third embodiment of this invention was produced.

Figure 7:
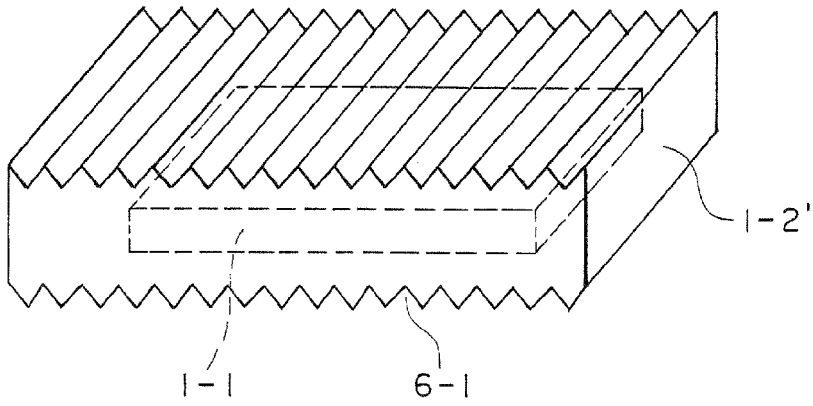
FIG. 7 is a perspective view of an acoustic vibration generating element according to a third embodiment of this invention in which V-shaped grooves are formed on a surface of a flexible material.

FIG. 7 shows the acoustic vibration generating element according to the third embodiment. The piezoelectric bimorph element 1-1 is covered with the covering member 1-2'. The covering member 1-2' is provided with a plurality of V-shaped grooves 6-1 on its two principal surfaces.

The acoustic vibration generating element illustrated in FIG. 7 was subjected to measurement using the artificial internal ear in the manner similar to that described in conjunction with the foregoing embodiments.

Figure 8:
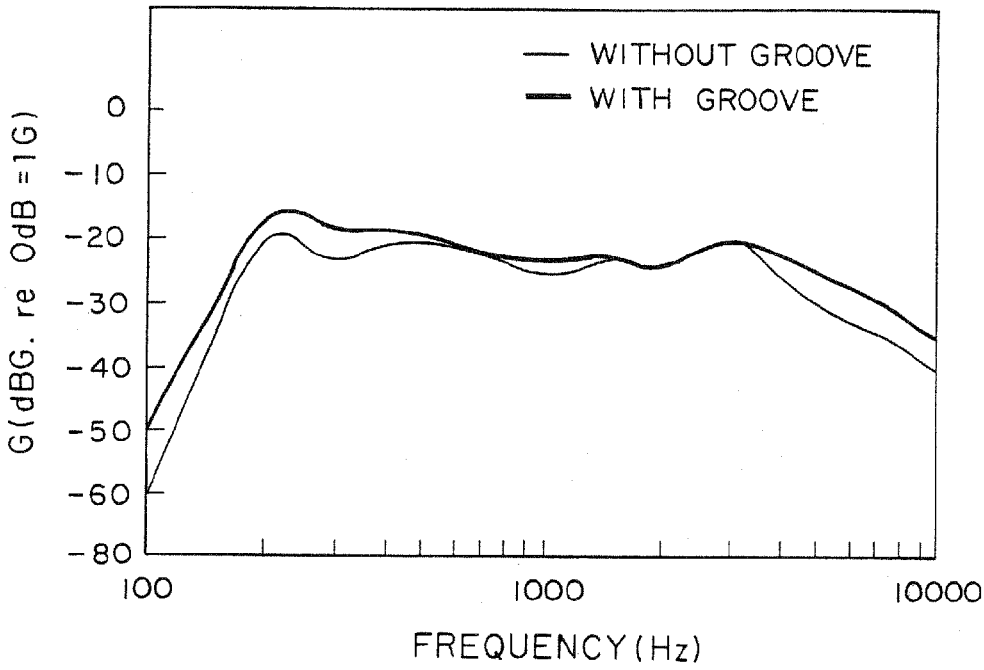
FIG. 8 is a view showing a result of comparison of acceleration in an artificial internal ear between the acoustic vibration generating element in FIG. 7 and an acoustic vibration generating element without the V-shaped grooves.

FIG. 8 shows the result of comparison of acceleration (G) in the artificial internal ear. As is obvious from FIG. 8, the acoustic vibration generating element having the V-shaped grooves has an acceleration slightly greater than that of the acoustic vibration generating element without the V-shaped grooves. The sound leakage had an equivalent level. This is because the presence of the V-shaped grooves facilitates bending and deformation so that the flexural modulus K is apparently decreased, resulting in an increase in generated force and in output level. Further, the output level is increased in a low frequency region. This is an effect similarly obtained by the decrease in flexural modulus K. Specifically, as will be understood from Equation (1), the resonance frequency $F_r$ is lowered due to the decrease in flexural modulus K. The shape of the grooves formed on the surface of the covering member is not limited to the V shape. The similar effect is obtained by the grooves having semicircular section or any other appropriate shape.

Fourth Embodiment

Covering Member with Air Chamber Formed on One Side

To one surface of the acoustic vibration generating element experimentally prepared in the second embodiment, a circular ring of soft rubber (having the outer diameter of 30 mm, the inner diameter of 25 mm, and the thickness of 1 mm) equal in diameter to the acoustic vibration generating element and a circular plate (having the diameter of 30 mm and the thickness of 1 mm) of the same material were successively adhered by the use of a rubber-based adhesive. Thus, an air chamber having the diameter of 25 mm and the thickness of 1 mm was formed on one side of the acoustic vibration generating element. Thus, an acoustic vibration generating element according to a fourth embodiment of this invention was produced.

Figure 9:
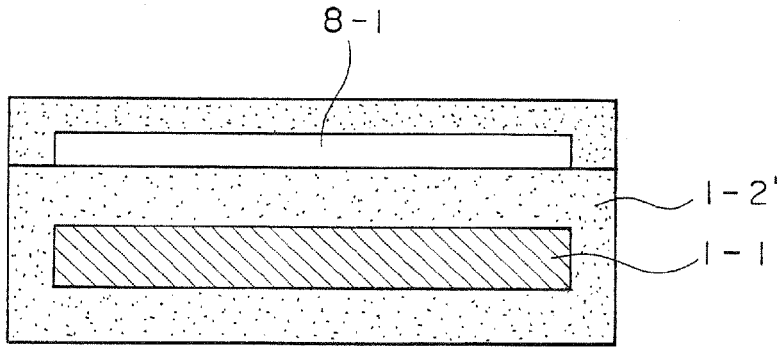
FIG. 9 is a sectional view of an acoustic vibration generating element according to a fourth embodiment of this invention in which an air chamber is formed on one side of a flexible material.

FIG. 9 shows the acoustic vibration generating element according to the fourth embodiment. The piezoelectric bimorph element 1-1 is covered with the covering member 1-2' of the flexible material. On one side of the acoustic vibration generating element, the air chamber 8-1 is formed. An output surface, i.e., the other side of the acoustic vibration generating element without the air chamber 8-1 was pressed against a part of a user's head and an acoustic signal was supplied. By presence of the air chamber 8-1, sound leakage from an opening surface on the one side is reduced.

In this embodiment, the air chamber 8-1 was formed by the rubber ring and the circular plate. Not being limited thereto, the air chamber may be formed in any other appropriate manner, for example, may be formed integrally with the covering member. Even in a structure such that the air chamber is connected to external air in the process of molding, the similar effect is obtained. As will readily be understood, the above-mentioned effect is obtained not in the piezoelectric bimorph element of a circular shape but also in the piezoelectric bimorph element of a rectangular shape similar to that described in the first embodiment.

Fifth Embodiment

Covering Member and Ear Hook are Integrally Molded by Flexible Material

Figure 10:
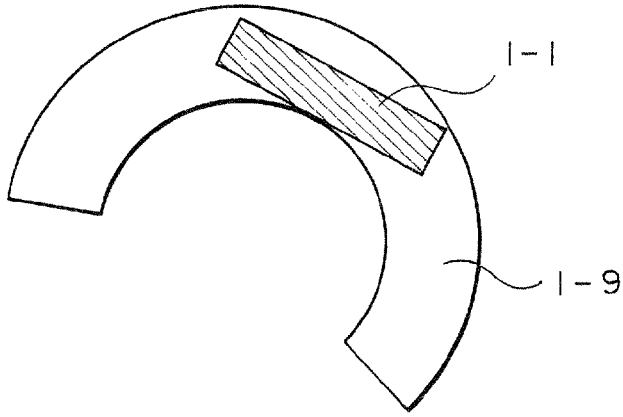
FIG. 10 is a view showing an acoustic vibration generating element according to a fifth embodiment of this invention in which a covering member of a flexible material and an earhook are integrally formed.

FIG. 10 shows an acoustic vibration generating element comprising the piezoelectric bimorph element 1-1 experimentally produced in the first embodiment and an ear hook 1-9 and the covering member are integrally molded by a covering silicone rubber.

Figure 11:
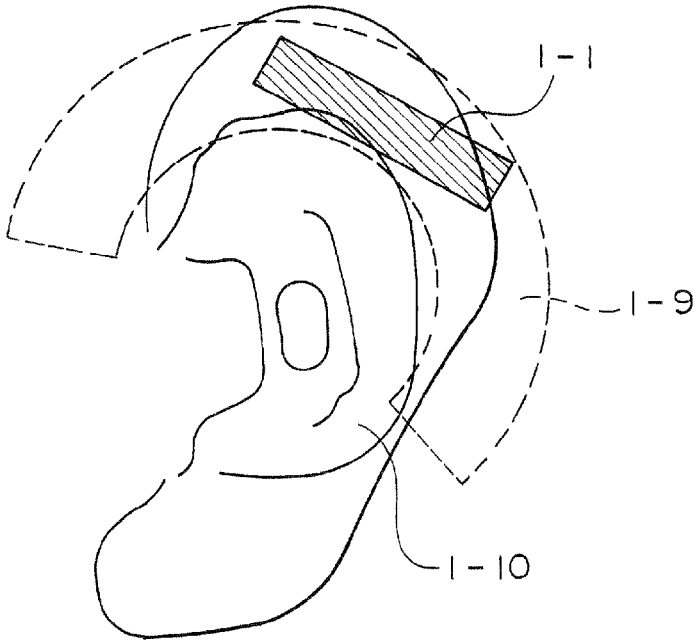
FIG. 11 is a view showing the acoustic vibration generating element in FIG. 10 when it is attached to a human ear.

FIG. 11 shows a state where the acoustic vibration generating element in FIG. 10 is attached to a human ear 1-10. As illustrated in FIG. 11, the acoustic vibration generating element is attached to the human ear 1-10. When an electric signal is supplied, a cartilage of an external ear and a cranial bone behind the ear are simultaneously stimulated so that a sound by bone conduction can be sensed more clearly.

Each of the first through the fifth embodiments has been described in connection with the acoustic vibration generating element in which a whole of the piezoelectric bimorph element is covered with the covering member. However, the similar effect is obtained in an acoustic vibration generating element in which the piezoelectric bimorph element is covered with the covering member on at least two surfaces perpendicular to the thickness direction thereof. Of course, this applies to the piezoelectric unimorph element.

As described above, this invention provides the acoustic vibration generating element which is capable of lowering the resonance frequency, decreasing the mechanical quality factor Q, and preventing the sound leakage. The acoustic vibration generating element has a robust and light-weight structure and has a wide frequency range. Therefore, the acoustic vibration generating element according to this invention is suitable for a bone conduction device, in particular, to a bone conduction speaker.

While this invention has thus far been described in connection with the preferred embodiments thereof, it will be readily possible for those skilled in the art to put this invention into practice in various other manners without departing from the scope of this invention.

What is claimed is:

1. A bone conduction acoustic vibration generating element comprising:

a piezoelectric bimorph or unimorph element; and a covering member made of a flexible material and attached to at least two surfaces perpendicular to a thickness direction of the piezoelectric bimorph or unimorph element, wherein a ratio of flexural modulus to a weight per unit length of the bone conduction acoustic vibration generating element is smaller than a ratio of flexural modulus to a weight per unit length of the piezoelectric bimorph or unimorph element only.

2. The bone conduction acoustic vibration generating element according to claim 1, wherein the covering member covers a whole of the piezoelectric bimorph or unimorph element.

3. The bone conduction acoustic vibration generating element according to claim 2, wherein the piezoelectric bimorph or unimorph element is a piezoelectric bimorph element which has a laminated structure comprising piezoelectric ceramics sheets and internal electrodes.

4. The bone conduction acoustic vibration generating element according to claim 3, further comprising an earhook portion made of the flexible material and integrally formed with the covering member.

5. The bone conduction acoustic vibration generating element according claim 2, further comprising an earhook portion made of the flexible material and integrally formed with the covering member.

6. The bone conduction acoustic vibration generating element according to claim 2, wherein the bone conduction acoustic vibration generating element radiates acoustic energy to a human body through at least a part of the flexible material.

7. The bone conduction acoustic vibration generating element according to claim 1, wherein the bone conduction acoustic vibration generating element radiates acoustic energy to a human body through at least a part of the flexible material.

8. The bone conduction acoustic vibration generating element according to claim 7, wherein the piezoelectric bimorph or unimorph element is a piezoelectric bimorph element which has a laminated structure comprising piezoelectric ceramics sheets and internal electrodes.

9. The bone conduction acoustic vibration generating element according to claim 8, further comprising an earhook portion made of the flexible material and integrally formed with the covering member.

10. The bone conduction acoustic vibration generating element according claim 7, further comprising an earhook portion made of the flexible material and integrally formed with the covering member.

11. The bone conduction acoustic vibration generating element according to claim 1, wherein a plurality of grooves are formed on a surface of the covering member.

12. The bone conduction acoustic vibration generating element according to claim 11, wherein the piezoelectric bimorph or unimorph element is a piezoelectric bimorph element which has a laminated structure comprising piezoelectric ceramics sheets and internal electrodes.

13. The bone conduction acoustic vibration generating element according to claim 12, further comprising an earhook portion made of the flexible material and integrally formed with the covering member.

14. The bone conduction acoustic vibration generating element according claim 11, further comprising an earhook portion made of the flexible material and integrally formed with the covering member.

15. The bone conduction acoustic vibration generating element according to claim 1, wherein the covering member is provided with an air chamber formed on one side thereof.

16. The bone conduction acoustic vibration generating element according to claim 15, wherein the piezoelectric bimorph or unimorph element is a piezoelectric bimorph element which has a laminated structure comprising piezoelectric ceramics sheets and internal electrodes.

17. The bone conduction acoustic vibration generating element according to claim 16, further comprising an earhook portion made of the flexible material and integrally formed with the covering member.

18. The bone conduction acoustic vibration generating element according claim 15, further comprising an earhook portion made of the flexible material and integrally formed with the covering member.

19. The bone conduction acoustic vibration generating element according to claim 1, wherein the piezoelectric bimorph or unimorph element is a piezoelectric bimorph element which has a laminated structure comprising piezoelectric ceramics sheets and internal electrodes.

20. The bone conduction acoustic vibration generating element according to claim 19, further comprising an earhook portion made of the flexible material and integrally formed with the covering member.

21. The bone conduction acoustic vibration generating element according claim 1, further comprising an earhook portion made of the flexible material and integrally formed with the covering member.

* * * * *